US008940139B2

(12) United States Patent
Asaumi et al.

(10) Patent No.: US 8,940,139 B2
(45) Date of Patent: Jan. 27, 2015

(54) GAS DIFFUSION ELECTRODE EQUIPPED ION EXCHANGE MEMBRANE ELECTROLYZER

(75) Inventors: Kiyohito Asaumi, Tamano (JP); Yukinori Iguchi, Tamano (JP); Mitsuharu Hamamori, Nagoya (JP); Tomonori Izutsu, Takasago (JP)

(73) Assignees: Chlorine Engineers Corp., Ltd., Tokyo (JP); Toagosei Co., Ltd., Tokyo (JP); Kaneka Corporation, Osaka (JP)

( * ) Notice: Subject to any disclaimer, the term of this patent is extended or adjusted under 35 U.S.C. 154(b) by 247 days.

(21) Appl. No.: 13/322,476

(22) PCT Filed: May 24, 2010

(86) PCT No.: PCT/JP2010/003469

§ 371 (c)(1), (2), (4) Date: Feb. 21, 2012

(87) PCT Pub. No.: WO2010/137283

PCT Pub. Date: Dec. 2, 2010

(65) Prior Publication Data

US 2012/0145559 A1 Jun. 14, 2012

(30) Foreign Application Priority Data

May 26, 2009 (JP) ..... 2009-126621

(51) Int. Cl.

| | |
|---|---|
| ***C25B 9/08*** | (2006.01) |
| ***C25B 1/16*** | (2006.01) |
| ***C25B 1/26*** | (2006.01) |

(52) U.S. Cl.

CPC ... *C25B 9/08* (2013.01); *C25B 1/16* (2013.01); *C25B 1/26* (2013.01)

USPC ..... 204/252; 204/265; 205/516; 205/526; 205/622; 205/624

(58) Field of Classification Search

USPC ..... 204/252, 265; 205/510, 516, 526, 624, 205/622

See application file for complete search history.

(56) References Cited

U.S. PATENT DOCUMENTS

| | | | | |
|---|---|---|---|---|
| 5,264,299 | A * | 11/1993 | Krasij et al. | 429/492 |
| 6,368,473 | B1 | 4/2002 | Furuya et al. | |
| 6,383,349 | B1 | 5/2002 | Sakata et al. | |
| 6,841,047 | B2 | 1/2005 | Gestermann et al. | |

(Continued)

FOREIGN PATENT DOCUMENTS

| | | | |
|---|---|---|---|
| CN | 1275175 | A | 11/2000 |
| CN | 1564878 | A | 1/2005 |
| CN | 1599808 | A | 3/2005 |
| JP | 09-078281 | A | 3/1997 |
| JP | 2000-282278 | A | 10/2000 |

(Continued)

*Primary Examiner* — Keith Hendricks
*Assistant Examiner* — Steven A. Friday
(74) *Attorney, Agent, or Firm* — Sughrue Mion, PLLC

(57) ABSTRACT

Provided is a gas diffusion electrode equipped ion exchange membrane electrolyzer including an anode, an ion exchange membrane, and a cathode chamber in which a gas diffusion electrode is disposed, wherein the ion exchange membrane and a cathode chamber inner space in which the gas diffusion electrode is disposed are separated by a liquid retaining member, the outer periphery of the liquid retaining member is held in a void formed in a gasket or a cathode chamber frame constituting the cathode chamber, or the outer periphery and the end face of the outer periphery of the liquid retaining member are sealed, or the outer periphery of the liquid retaining member is joined to and integrated with the gasket.

5 Claims, 4 Drawing Sheets

(56) References Cited

U.S. PATENT DOCUMENTS

| | | | |
|---|---|---|---|
| 6,890,418 | B2 | 5/2005 | Bulan et al. |
| 2007/0095676 | A1 | 5/2007 | Yamada et al. |
| 2009/0071820 | A1 | 3/2009 | Saiki et al. |

FOREIGN PATENT DOCUMENTS

| | | | |
|---|---|---|---|
| JP | 2002-275670 | A | 9/2002 |
| JP | 2006-322018 | A | 11/2006 |
| JP | 2007-119881 | A | 5/2007 |

* cited by examiner

GAS DIFFUSION ELECTRODE EQUIPPED ION EXCHANGE MEMBRANE ELECTROLYZER

CROSS REFERENCE TO RELATED APPLICATIONS

This application is a National Stage of International Application No. PCT/JP2010/003469 filed May 24, 2010, claiming priority based on Japanese Patent Application No. 2009-126621 filed May 26, 2009, the contents of all of which are incorporated herein by reference in their entirety.

TECHNICAL FIELD

The present invention relates to a gas diffusion electrode equipped ion exchange membrane electrolyzer for use in electrolysis of an alkali metal chloride aqueous solution such as brine and, more particularly, to a gas diffusion electrode equipped ion exchange membrane electrolyzer suitably applied to a two-chamber type gas diffusion electrode equipped ion exchange membrane electrolyzer.

BACKGROUND ART

A gas diffusion electrode equipped ion exchange membrane electrolyzer provided with a gas diffusion electrode is utilized as a means for reducing electrolysis voltage by causing a reaction with a gas introduced from outside at the gas diffusion electrode.

In a gas diffusion electrode equipped ion exchange membrane electrolyzer for alkali metal chloride aqueous solution wherein the gas diffusion electrode is used as a cathode, an alkali chloride aqueous solution is supplied to an anode chamber so as to generate a chlorine gas at an anode. On the other hand, an oxygen-containing gas is supplied to a cathode chamber, whereby at the gas diffusion electrode, the oxygen is reduced, and further, an alkali metal hydroxide aqueous solution is generated.

When operation of the electrolyzer is stopped, a chlorine evolution reaction and an oxygen reduction reaction are stopped; while the potentials of the anode and anode chamber are kept at a chlorine evolution potential since the chlorine exists in solution in the alkali metal chloride aqueous solution which is an anolyte. On the other hand, the gas diffusion electrode and cathode chamber are subjected to a condition where they contact the alkali metal hydroxide aqueous solution and oxygen-containing gas, so that the voltage potentials of the gas diffusion electrode and cathode gas chamber are kept at an oxygen reduction potential.

However, when the operation is stopped, generation of the alkali metal hydroxide aqueous solution is stopped in the cathode chamber although the anolyte remains in the anode chamber, so that only a tiny amount of alkali metal hydroxide aqueous solution retained in a hydrophilic layer exists in the cathode chamber side.

When the anolyte in the anode chamber is transferred through the ion exchange membrane and poured into the cathode chamber according to the concentration gradient between the anode chamber and cathode chamber, a catholyte is replaced by the anolyte.

Originally, the cathode chamber is made of a material having a sufficient corrosion resistance against the alkali metal hydroxide aqueous solution having alkaline property. However, the corrosion resistance of the cathode chamber is not sufficient against, e.g., the alkali metal chloride aqueous solution having a pH ranging from acidic to neutral.

There is proposed, as an electrolyzer protection method which is employed in a gas diffusion electrode equipped ion exchange membrane electrolyzer in which a cathode chamber and an anode chamber are separated by an ion exchange membrane and which prevents corrosion of a cathode chamber and degradation of a catalyst during the stop time of the electrolyzer, a method of protecting the gas diffusion electrode equipped ion exchange membrane electrolyzer by stopping supply of an oxygen-containing gas to the cathode chamber and replacing the oxygen-containing gas atmosphere in the cathode chamber with an alkali metal hydroxide aqueous solution (refer to e.g., Patent Document 1).

CITATION LIST

Patent Document

Patent Document 1: JP-A-2004-300510

DISCLOSURE OF THE INVENTION

Problems to be Solved by the Invention

Although the related art as described above serves as a means capable of coping with various problems occurring during the stop time of the gas diffusion electrode equipped ion exchange membrane electrolyzer, it needs to perform, at the time when the gas diffusion electrode equipped ion exchange membrane electrolyzer is stopped, operations of stopping supply of the oxygen-containing gas to the cathode chamber and then replacing the atmosphere in the cathode chamber by an alkali metal hydroxide aqueous solution. Further, in this related art, the protection of the cathode chamber is not started immediately after the stop of the operation.

Means for Solving the Problems

According to the present invention, there is provided a gas diffusion electrode equipped ion exchange membrane electrolyzer having an anode, an ion exchange membrane, and a cathode chamber in which a gas diffusion electrode is disposed, characterized in that the ion exchange membrane and a cathode chamber inner space in which the gas diffusion electrode is disposed are separated by a liquid retaining member, the outer periphery of the liquid retaining member is held in a void formed in a gasket or a cathode chamber frame constituting the cathode chamber, or the outer periphery and the end face of the outer periphery of the liquid retaining member are sealed, or the outer periphery of the liquid retaining member is joined to and integrated with the gasket.

In the gas diffusion electrode equipped ion exchange membrane electrolyzer, the liquid retaining member is a hydrophilic member that retains a liquid within the inner space thereof.

In the gas diffusion electrode equipped ion exchange membrane electrolyzer, the hydrophilic member is a carbon fiber fabric or a carbon fiber nonwoven fabric.

In the gas diffusion electrode equipped ion exchange membrane electrolyzer, the liquid retaining member is held at its periphery by the gasket disposed between itself and cathode chamber frame.

In the gas diffusion electrode equipped ion exchange membrane electrolyzer, the liquid retaining member is held at its periphery by the gasket disposed between itself and ion exchange membrane.

Advantages of the Invention

A gas diffusion electrode equipped ion exchange membrane electrolyzer according to the present invention has a configuration in which an ion exchange membrane and a cathode chamber inner space including a gas diffusion electrode are separated by a liquid retaining member. This prevents an anolyte that has been transferred through the ion exchange membrane from an anode chamber from reaching a cathode chamber wall surface and the like during stop time of the electrolyzer, allowing performance of the electrolyzer to be maintained for a long period of time.

BRIEF DESCRIPTION OF THE DRAWINGS

FIGS. 2A to 2C are each a cross-sectional view for explaining another embodiment of the gas diffusion electrode equipped ion exchange membrane electrolyzer according to the present invention, in which FIG. 2A is a cross-sectional view illustrating an embodiment of the gas diffusion electrode equipped ion exchange membrane electrolyzer according to the present invention, FIG. 2B is a cross-sectional view illustrating another embodiment of the gas diffusion electrode equipped ion exchange membrane electrolyzer according to the present invention, and FIG. 2C is a cross-sectional view illustrating another embodiment of the gas diffusion electrode equipped ion exchange membrane electrolyzer according to the present invention, each of which is a partial cross-sectional view illustrating only the upper portion of the gas diffusion electrode equipped ion exchange membrane electrolyzer of FIG. 1.

FIGS. 3A to 3C are each a cross-sectional view for explaining another embodiment of the gas diffusion electrode equipped ion exchange membrane electrolyzer according to the present invention, in which FIG. 3A is a cross-sectional view illustrating an embodiment of the gas diffusion electrode equipped ion exchange membrane electrolyzer according to the present invention, FIG. 3B is a cross-sectional view illustrating another embodiment of the gas diffusion electrode equipped ion exchange membrane electrolyzer according to the present invention, and FIG. 3C is a cross-sectional view illustrating another embodiment of the gas diffusion electrode equipped ion exchange membrane electrolyzer according to the present invention, each of which is a partial cross-sectional view illustrating only the upper portion of the gas diffusion electrode equipped ion exchange membrane electrolyzer of FIG. 1.

FIGS. 4A and 4B are each a cross-sectional view for explaining an embodiment of the gas diffusion electrode equipped ion exchange membrane electrolyzer, in which FIG. 4A is a cross-sectional view for explaining an embodiment of the gas diffusion electrode equipped ion exchange membrane electrolyzer, which is a partial cross-sectional view illustrating only the upper portion of the gas diffusion electrode equipped ion exchange membrane electrolyzer of FIG. 1, and FIG. 4B is a view enlarging the part A of FIG. 4A.

BEST MODE FOR CARRYING OUT THE INVENTION

The present invention has found that by separating between an ion exchange membrane and a cathode chamber inner space in which a gas diffusion electrode is disposed using a liquid retaining member, it is possible to prevent the inside of a cathode chamber from being impaired by an anolyte which is transferred through the ion exchange membrane from an anode chamber to the cathode chamber according to the concentration gradient at the time when the gas diffusion electrode equipped ion exchange membrane electrolyzer is stopped.

Embodiments of the present invention will be described below with reference to the accompanying drawings.

Figure 1:
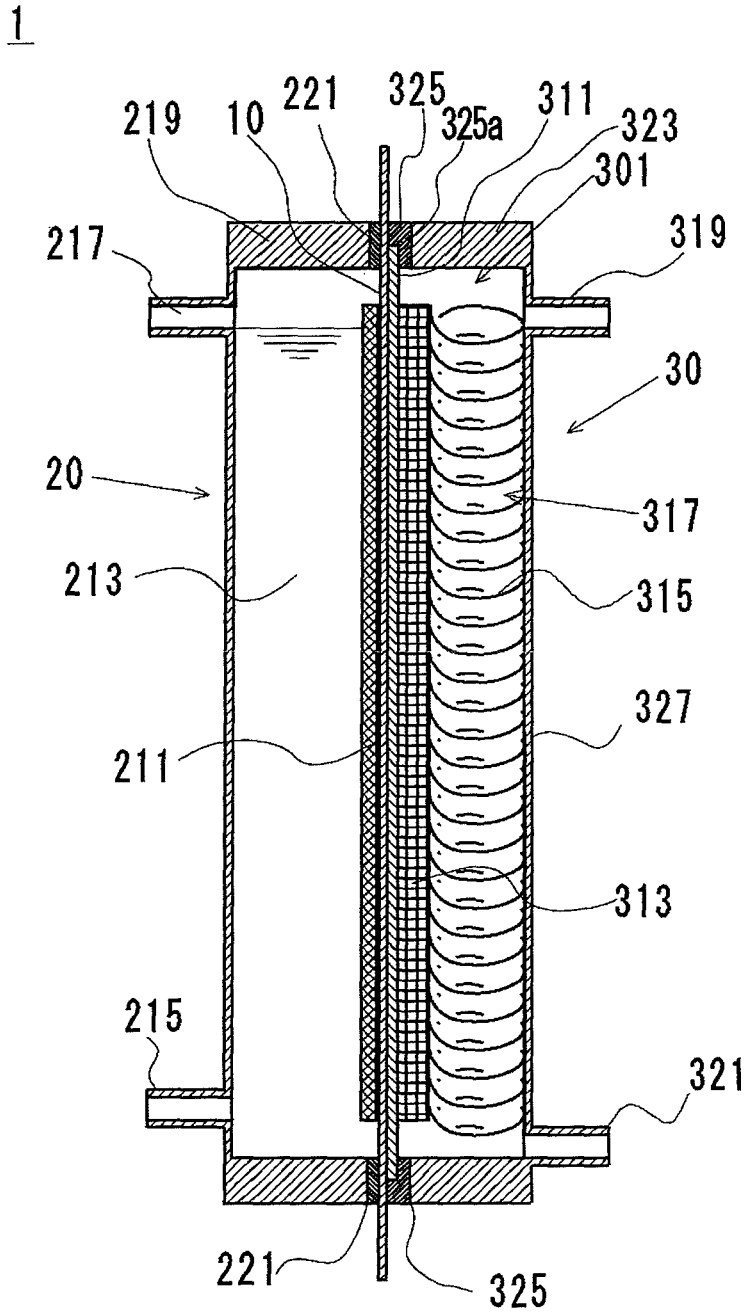
FIG. 1 is a cross-sectional view for explaining an embodiment of a gas diffusion electrode equipped ion exchange membrane electrolyzer according to the present invention.

FIG. 1 is a cross-sectional view for explaining an embodiment of a gas diffusion electrode equipped ion exchange membrane electrolyzer according to the present invention.

The following description is made taking a gas diffusion electrode equipped ion exchange membrane electrolyzer for use in electrolysis of brine, in which a single anode chamber and a single cathode chamber are stacked through an ion exchange membrane.

FIG. 1 is a cross-sectional view obtained by cutting the gas diffusion electrode equipped ion exchange membrane electrolyzer along a plane orthogonal to an electrode surface.

A gas diffusion electrode equipped ion exchange membrane electrolyzer 1 has a configuration called a two-chamber type gas diffusion electrode equipped ion exchange membrane electrolyzer, in which an anode chamber 20 and a cathode chamber 30 provided therein are separated by an ion exchange membrane 10.

The anode chamber 20 has an anode 211 and is filled with brine as an anolyte 213. An anolyte inlet 215 is formed at the lower portion of the anode chamber 20.

An outlet 217 for anolyte whose concentration has been decreased by electrolysis and gas is formed at the upper portion of the anode chamber, and an anode chamber frame 219 is stacked to the ion exchange membrane 10 through an anode chamber side gasket 221.

The cathode chamber 30 is provided on the opposite side to the anode chamber 20 with respect to the ion exchange membrane 10, and a gas diffusion electrode 313 is provided in the cathode chamber.

A liquid retaining member 311 is disposed between a cathode chamber inner space 301 including the gas diffusion electrode 313 and the ion exchange membrane 10.

The liquid retaining member 311 is held between cathode chamber side gaskets 325 each of which extends outside beyond the outer periphery of the liquid retaining member 311 and, in this state, the outer periphery of the liquid retaining member is held in a void 325*a* formed in each of the cathode chamber side gaskets, thereby ensuring air tightness.

As illustrated in FIG. 1, in the present invention, the void formed in the gasket means a concave portion formed as a result of partial deformation of the gasket caused when the outer periphery of the liquid retaining member is held by the gasket or a concave portion previously formed in the gasket.

As described above, all the portions of the liquid retaining member 311, including a part at which it is stacked to a cathode chamber frame 323 or end face thereof are not exposed to a space outside the gas diffusion electrode equipped ion exchange membrane electrolyzer 1, thus preventing leakage of a gas or liquid through the liquid retaining member 311.

On one side of the gas diffusion electrode 313 opposite to the liquid retaining member 311 side, an elastic member 315 which is made of cotton and which has inside thereof a space through which a gas can be passed is disposed.

The elastic member 315 brings the gas diffusion electrode 313 and the liquid retaining member 311 into firm contact with the ion exchange membrane 10 side to form a cathode gas chamber 317 within the cathode chamber and makes contact with a back plate 327 of the cathode chamber 30 to form a conducting circuit between the gas diffusion electrode 313 and the back plate 327.

When an alkali metal chloride aqueous solution is supplied to the anode chamber 20 of the gas diffusion electrode equipped ion exchange membrane electrolyzer 1 and then current is applied between the anode 211 and the gas diffusion electrode 313 while an oxygen-containing gas is supplied to the cathode gas chamber 317 of the cathode chamber 30 through an oxygen inlet 319, the gas diffusion electrode 313 is supplied with the fluid content of an alkali metal hydroxide aqueous solution from the liquid retaining member 311 as well as supplied with the oxygen-containing gas from the cathode gas chamber 317 side, resulting in progress of a generating reaction of the alkali metal hydroxide aqueous solution in the gas diffusion electrode 313.

The generated alkali metal hydroxide aqueous solution is transferred to the liquid retaining member 311 according to the concentration gradient and absorbed/retained by the liquid retaining member 311, as well as flows down along the inside of the liquid retaining member 311 and cathode gas chamber side of the gas diffusion electrode 313 to be discharged from a cathode gas chamber outlet 321.

Since a high concentration oxygen, a water vapor, and mist of the alkali metal hydroxide aqueous solution exist in the cathode gas chamber 317 of the cathode chamber, and temperature of the cathode gas chamber 317 reaches about 90° C., the cathode chamber is made of nickel, a nickel alloy, or the like. Further, the elastic member is made of a metal material having a high corrosion resistance and a high conductivity, such as nickel or a high nickel alloy.

While an electrolysis reaction progresses in the gas diffusion electrode equipped ion exchange membrane electrolyzer 1 according to the present invention, the potential of the gas diffusion electrode 313 becomes lower than an oxygen reduction potential by the magnitude of overvoltage. When the electrolysis is stopped, the potential of the gas diffusion electrode 313 becomes equal to the oxygen reduction potential, that is, the potential of the gas diffusion electrode 313 becomes higher than that while the electrolysis is in progress.

Under such a condition, corrosions of the inner wall surface of the cathode chamber 30, elastic member 315, and the like proceed in the presence of oxygen even though they are made of a nickel-based material.

When the alkali metal chloride aqueous solution is transferred from the anode chamber 20 to the cathode chamber 30 through the ion exchange membrane 10, the pH of the inside of the cathode gas chamber 317 changes from alkaline to neutral. Further, the presence of the alkali metal chloride and the like causes corrosions of the inner wall surface of the cathode chamber 30, back plate 327, and elastic member 315.

In the gas diffusion electrode equipped ion exchange membrane electrolyzer 1 according to the present invention, the ion exchange membrane 10 and cathode chamber inner space 301 in which the gas diffusion electrode 313 is disposed are separated by the liquid retaining member 311.

As a result of the presence of the liquid retaining member 311 between the cathode chamber inner space 301 and ion exchange membrane 10, even if the anolyte filled in the anode chamber 20 is transferred to the cathode chamber 30 side through the ion exchange membrane 10 according to the concentration gradient at the stop time of operation, it is retained in the liquid retaining member 311, thereby preventing the inner wall surface of the cathode chamber 30 or elastic member 315 from being impaired.

Figure 2A:
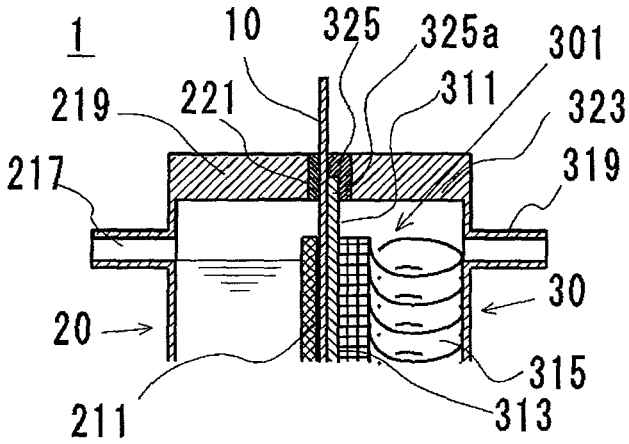
Figure 2B:
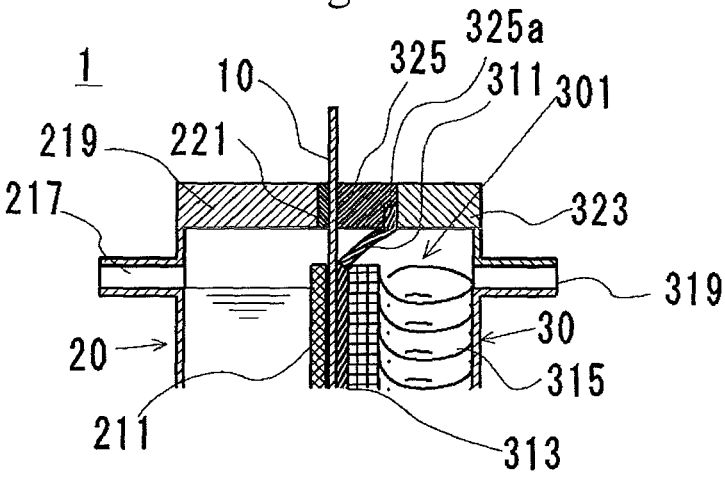
Figure 2C:
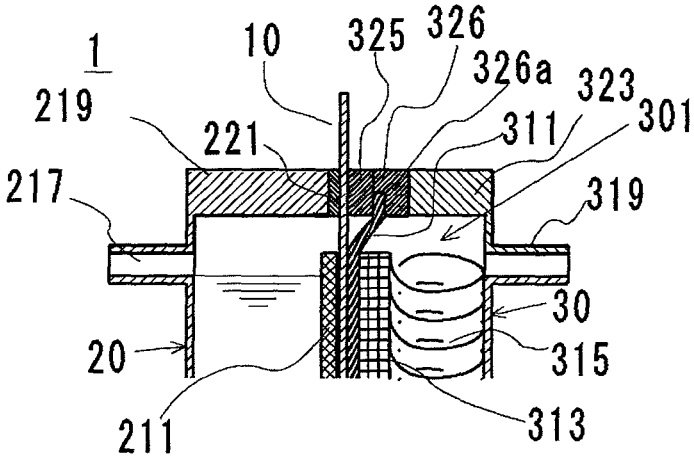

FIGS. 2A to 2C are each a cross-sectional view for explaining another embodiment of the gas diffusion electrode equipped ion exchange membrane electrolyzer according to the present invention. FIGS. 2A, 2B, and 2C are each a partial cross-sectional view illustrating only the upper portion of the gas diffusion electrode equipped ion exchange membrane electrolyzer of FIG. 1.

The gas diffusion electrode equipped ion exchange membrane electrolyzer 1 illustrated in FIG. 2A has a configuration in which the cathode chamber 30 includes the gas diffusion electrode 313, the upper portion of the liquid retaining member 311 disposed so as to contact the ion exchange membrane 10 is fitted into the void 325*a* formed in cathode chamber side gasket 325 so as to be opened in the cathode chamber inner side, and the cathode chamber frame 323 is disposed on one side of the cathode chamber side gasket 325 opposite to the ion exchange membrane 10 side. Further, the elastic member 315 is disposed at the back side of the gas diffusion electrode 313.

On the other hand, on the anode chamber 20 side of the ion exchange membrane 10, the anode chamber side gasket 221 and anode chamber frame 219 are disposed so as to be integrally stacked.

The cathode chamber inner space 301 and ion exchange membrane 10 are completely separated by the liquid retaining member 311. Further, at the outer periphery of the liquid retaining member 311, one surface is brought into firm contact with the ion exchange membrane and other remaining surfaces are held by the void 325*a* of the cathode chamber side gasket 325. Therefore, there is no passage from the porous liquid retaining member 311 to the outside space, ensuring air tightness of the gas diffusion electrode equipped ion exchange membrane electrolyzer 1.

Although a configuration in which a step portion corresponding to the thickness of the liquid retaining member is formed in the gasket so as to allow fitting of the gasket has been taken as an example in the above description, a groove into which the liquid retaining member can be fitted may be formed in place of the step portion.

In the case where the step portion or groove for fitting is formed in the gasket as described above, it is possible to reliably prevent leakage of a liquid or gas from the stacking surface of the liquid retaining member or end face of the outer periphery of the liquid retaining member even if a thick member is used as the liquid retaining member, thus preventing corrosion of the inside of the cathode gas chamber during the stop time of the gas diffusion electrode equipped ion exchange membrane electrolyzer, which allows performance of the electrolyzer to be maintained for a long period of time.

FIG. 2B is a partial cross-sectional view for explaining another embodiment, which illustrates only the upper portion of the electrolyzer.

The gas diffusion electrode equipped ion exchange membrane electrolyzer 1 illustrated in FIG. 1 or FIG. 2A has a configuration in which the cathode chamber 30 includes the gas diffusion electrode 313, and the periphery of the liquid retaining member 311 is sealed by one side of the cathode chamber side gasket 325 that contacts the ion exchange membrane 10. On the other hand, in the gas diffusion electrode equipped ion exchange membrane electrolyzer 1 illustrated in FIG. 2B, a seal portion is provided between the liquid retaining member 311 and the cathode chamber frame 323. The elastic member 315 is disposed on the back side of the gas diffusion electrode 313.

On the other hand, on the anode chamber 20 side of the ion exchange membrane 10, the anode chamber side gasket 221 and anode chamber frame 219 are disposed so as to be integrally stacked.

In this example, in the case where the liquid retaining member 311 has a reduced thickness, holding of the liquid retaining member 311 by the cathode chamber side gasket 325 deforms the liquid retaining member 311 to form the void 325*a*. Thus, without forming the step portion or groove for fitting the liquid retaining member 311, the outer periphery of the liquid retaining member 311, including the end face of the outer periphery can be sealed by the cathode chamber side gasket 325.

In the case where the liquid retaining member 311 has an increased thickness, the void 325*a* is previously formed in the cathode chamber side gasket 325 and then the liquid retaining member 311 is fitted to the void 325*a*, as in the case of FIG. 2A, whereby the cathode chamber inner space 301 and ion exchange membrane 10 are completely separated by the liquid retaining member 311. Therefore, there is no passage from the porous liquid retaining member 311 to the outside space, ensuring air tightness of the gas diffusion electrode equipped ion exchange membrane electrolyzer 1.

Further, during the stop time of the gas diffusion electrode equipped ion exchange membrane electrolyzer, corrosion of the inside of the cathode gas chamber can be prevented, which allows performance of the electrolyzer to be maintained for a long period of time.

FIG. 2C is a partial cross-sectional view for explaining another embodiment of the gas diffusion electrode equipped ion exchange membrane electrolyzer, which illustrates only the upper portion of the electrolyzer.

In the gas diffusion electrode equipped ion exchange membrane electrolyzer 1 illustrated in FIG. 2B, the outer periphery of the liquid retaining member 311 is disposed on the cathode chamber frame 323 side of the cathode chamber side gasket 325. On the other hand, in the example of FIG. 2C, the cathode chamber 30 includes the gas diffusion electrode 313, and in addition to the cathode chamber side gasket 325, a cathode chamber frame side gasket 326 is provided on the cathode chamber frame 323 side. The outer periphery of both surfaces of the liquid retaining member 311 is held in the gasket, and air tightness can be ensured by a void formed in the gasket.

Further, the elastic member 315 is disposed at the back side of the gas diffusion electrode 313. On the other hand, on the anode chamber 20 side of the ion exchange membrane 10, the anode chamber side gasket 221 and anode chamber frame 219 are disposed so as to be integrally stacked.

Further, as in the case of FIG. 2A, a configuration may be employed in which a void 326*a* is previously formed in the cathode chamber frame side gasket 326 on the side facing the cathode chamber side gasket, and the outer periphery of the liquid retaining member 311 is fitted into the void 326*a* to be stacked.

In the example illustrated in FIG. 2C, the outer periphery of the liquid retaining member 311 is covered by the cathode chamber side gasket 325 and cathode chamber frame side gasket 326, thereby providing a gas diffusion electrode equipped ion exchange membrane electrolyzer in which the air tightness of the liquid retaining member 311 can be ensured more reliably.

Figure 3A:
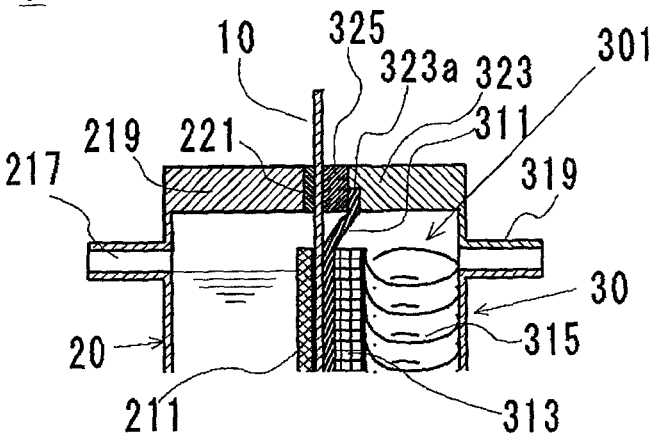
Figure 3B:
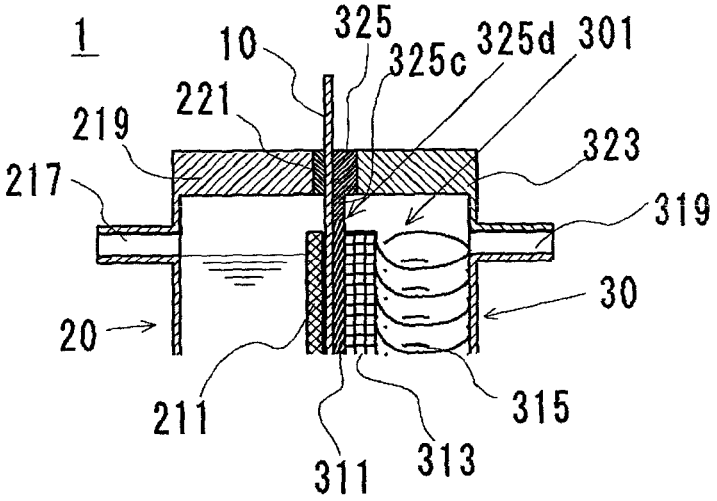
Figure 3C:
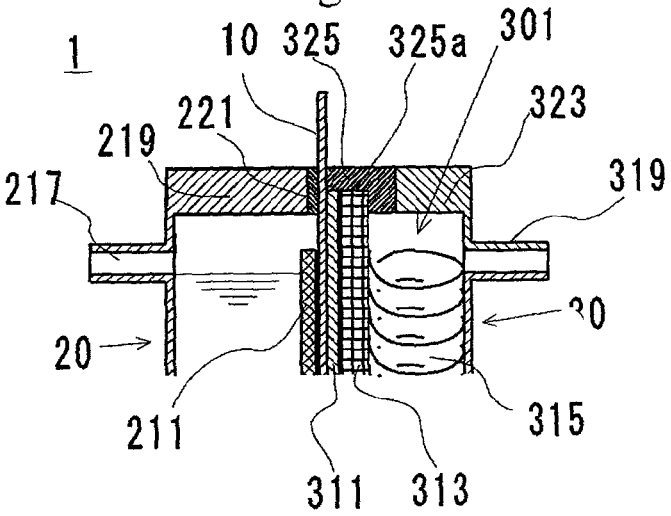

FIGS. 3A to 3C are each a cross-sectional view for explaining another embodiment of the gas diffusion electrode equipped ion exchange membrane electrolyzer according to the present invention. FIGS. 3A, 3B, and 3C are each a partial cross-sectional view illustrating only the upper portion of the gas diffusion electrode equipped ion exchange membrane electrolyzer of FIG. 1.

In the electrolyzer illustrated in FIG. 2A, the void 325*a* is formed in the cathode chamber side gasket 325 on the cathode chamber frame 323 side thereof, and the outer periphery of the liquid retaining member 311 is fitted to the void 325*a*. On the other hand, in the electrolyzer illustrated in FIG. 3A, the cathode chamber 30 includes the gas diffusion electrode 313, and the elastic member 315 is disposed at the back side of the gas diffusion electrode 313. Further, the void 323*a* is formed in the cathode chamber frame 323, and the outer periphery of the liquid retaining member 311 is fitted into the void 323*a* to be stacked.

On the other hand, on the anode chamber 20 side of the ion exchange membrane 10, the anode chamber side gasket 221 and anode chamber frame 219 are disposed so as to be integrally stacked.

As a result, one surface of the liquid retaining member 311 is sealed by the cathode chamber side gasket 325, and all the remaining surfaces thereof are covered by the void 323*a* formed in the cathode chamber frame 323. Thus, even in the case of the porous liquid retaining member 311 having an increased thickness, a passage leading to the outside space from the porous liquid retaining member 311 can easily be closed, thereby ensuring air tightness of the gas diffusion electrode equipped ion exchange membrane electrolyzer 1. Further, during the stop time of the gas diffusion electrode equipped ion exchange membrane electrolyzer, corrosion of the inside of the cathode gas chamber can be prevented, which allows performance of the electrolyzer to be maintained for a long period of time.

FIG. 3B is a view for explaining another embodiment of the present invention.

In the embodiments as described above, the outer periphery of the liquid retaining member 311 is held by the gasket, whereby the liquid retaining member 311, including the end face thereof, is maintained at air tight condition. On the other hand, in the electrolyzer of FIG. 3B, the cathode chamber 30 includes the gas diffusion electrode 313, and the cathode chamber side gasket 325 has a gasket extension portion 325*c* extending to the cathode chamber inner space 301. The gasket extension portion 325*c* and liquid retaining member 311 are joined to each other at a joining portion 325*d*. Further, as in the case of the other embodiments, the elastic member 315 is disposed at the back side of the gas diffusion electrode 313.

On the other hand, on the anode chamber 20 side of the ion exchange membrane 10, the anode chamber side gasket 221 and anode chamber frame 219 are disposed so as to be integrally stacked.

As a result, the liquid retaining member 311 is entirely positioned within the cathode chamber inner space 301. Thus, as in the case of the other embodiments, during the stop time of the gas diffusion electrode equipped ion exchange membrane electrolyzer, corrosion of the inside of the cathode gas chamber can be prevented, which allows performance of the electrolyzer to be maintained for a long period of time.

FIG. 3C is a view for explaining another embodiment.

In the embodiments described above, the gas diffusion electrode 313 does not extend to the space formed by the cathode chamber frame 323. On the other hand, in the electrolyzer of FIG. 3C, both the liquid retaining member 311 and gas diffusion electrode 313 extend up to the void 325*a* formed in the cathode chamber side gasket 325 and are fitted thereinto. Further, the elastic member 315 is disposed at the back side of the gas diffusion electrode 313.

On the other hand, on the anode chamber 20 side of the ion exchange membrane 10, the anode chamber side gasket 221 and anode chamber frame 219 are disposed so as to be integrally stacked.

The ion exchange membrane 10 and cathode chamber inner space 301 are separated by the liquid retaining member 311 whose periphery has been fitted into the void formed in the gasket and sealed thereby, so that there is no passage from the liquid retaining member 311 to the outside space, ensuring air tightness of the gas diffusion electrode equipped ion exchange membrane electrolyzer 1. Further, during the stop time of the gas diffusion electrode equipped ion exchange membrane electrolyzer, corrosion of the inside of the cathode gas chamber can be prevented, which allows performance of the electrolyzer to be maintained for a long period of time.

Figure 4A:
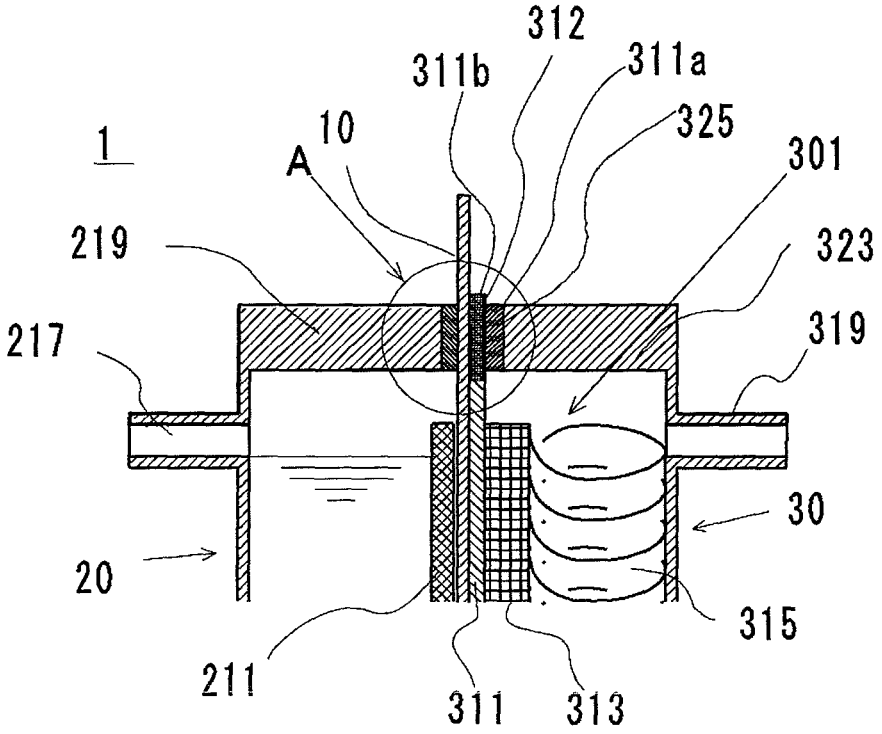
Figure 4B:
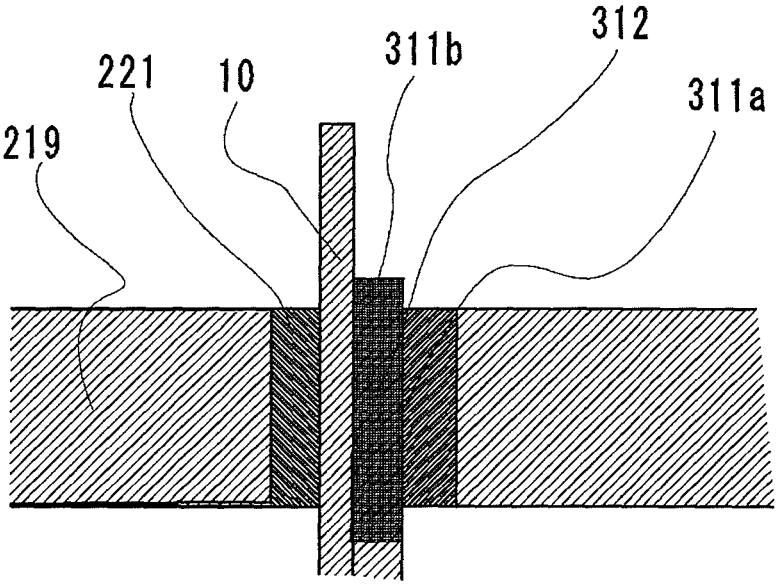

FIGS. 4A and 4B are each a view for explaining an embodiment of the gas diffusion electrode equipped ion exchange membrane electrolyzer according to the present invention. FIG. 4A is a partial cross-sectional view illustrating only the upper portion of the gas diffusion electrode equipped ion exchange membrane electrolyzer of FIG. 1. FIG. 4B is a view enlarging the part A of FIG. 4A.

The gas diffusion electrode equipped ion exchange membrane electrolyzer 1 illustrated in FIG. 1A, FIG. 1B, FIG. 1C or FIG. 2A, the cathode chamber 30 includes the gas diffusion electrode 313, and the periphery of the liquid retaining member 311 is sealed by one side of the cathode chamber side gasket 325 that contacts the ion exchange membrane 10. On the other hand, in the gas diffusion electrode equipped ion exchange membrane electrolyzer 1 of FIG. 4A, a sealing portion 312 is formed on a surface 311*a* of the outer periphery of the liquid retaining member 311 that contacts the gasket and an end face 311*b* of the outer periphery of the liquid retaining member 311. Further, the elastic member 315 is disposed at the back side of the gas diffusion electrode 313.

On the other hand, on the anode chamber 20 side of the ion exchange membrane 10, the anode chamber side gasket 221 and anode chamber frame 219 are disposed so as to be integrally stacked.

At a portion obtained by projecting a part of the cathode chamber frame 323 that contacts the gasket with respect to the liquid retaining member 311, the sealing portion 312 obtained by sealing a void for retaining a liquid is formed. Thus, even if the outer shape of the liquid retaining member is formed to have the same size as that of the cathode chamber frame 323 or cathode chamber side gasket 325 and stacked, leakage of a liquid or gas from the edge of the stacking surface can be prevented.

The formation of the sealing portion on the liquid retaining member 311 facilitates positioning of the liquid retaining member 311 and cathode chamber side gasket 325 in the assembly time of the electrolyzer, thereby providing an easily-assembled gas diffusion electrode equipped ion exchange membrane electrolyzer.

The sealing portion 312 can be formed by impregnation of the outer periphery of the liquid retaining member with a liquid member and subsequent hardening. Examples of the liquid member include a liquid rubber and a silicone sealant member.

Hereinafter, the present invention will be described based on Example and Comparative Example.

EXAMPLE

Example 1

An anode for brine electrolysis (Permelec Electrode Ltd.) having an effective electrode area of 620 mm (width)×1220 mm (height) and an ion exchange membrane (Aciplex F4403 made by Asahi Kasei Chemicals Corporation) were stacked on the anode chamber frame. A carbon fiber fabric (made by Zoltek) having a size of 630 mm (width)×1230 mm (height)× 0.4 mm (thickness) which is larger than the inner diameter of the gasket by 5 mm was stacked on the ion exchange membrane as the liquid retaining member. Further, a gas diffusion electrode for brine electrolysis (Permelec Electrode Ltd.) having an effective electrode area of 620 mm (width)×1220 mm (height) was stacked on the carbon fiber fabric, and four elastic members each obtained by winding a nickel wire having a wire diameter of 0.17 mm in a coil shape having a winding width of 0.4 mm and a winding diameter of 6 mm were disposed on the gas diffusion electrode. Subsequently, a gasket whose stacking surface with respect to the cathode chamber frame had a width of 40 mm was stacked to seal the periphery of the carbon fiber fabric, whereby the gas diffusion electrode equipped ion exchange membrane electrolyzer was produced.

Brine was supplied so as to make the concentration in the anode chamber become 150 g/l to 220 g/l, an oxygen-containing gas is supplied to the cathode chamber so as to keep the temperature in the cathode chamber at 80° C., current density was set to 3 kA/$m^2$, and aqueous sodium hydroxide concentration was kept at 32 mass % to 34 mass %. Under the above conditions, the gas diffusion electrode equipped ion exchange membrane electrolyzer was operated for a total period of 300 days with 56 days of a total shutdown period (operation pattern: continuous operation period=37 days to 38 days; and operation shutdown period=1 day to 3 days). When the electrolyzer was disassembled after the total operation time, no corrosion was observed on the stacking surface of the cathode chamber frame to the gasket.

Comparative Example 1

A gas diffusion electrode equipped ion exchange membrane electrolyzer was produced in the same manner as Example 1 except that the liquid retaining member smaller in size than the inner diameter of the gasket by 5 mm was disposed between the ion exchange membrane and gas diffusion electrode.

Then, in view of a fact that the corrosion in the cathode chamber occurs during the operation stop time, the presence/absence of occurrence of the corrosion was checked by changing the operation stop time as follows.

The gas diffusion electrode equipped ion exchange membrane electrolyzer was operated for a total period of 265 days with 162 days of a total stop period (operation pattern: continuous operation period=38 days to 110 days; and operation shutdown period=1 day to 24 days). When the electrolyzer was disassembled after the total operation time, pitting corrosion was found to occur on the inner surface of the cathode chamber frame. Further, corrosion was found to occur at ¼ part of the stacking surface of the cathode chamber frame with respect to the gasket.

INDUSTRIAL APPLICABILITY

The gas diffusion electrode equipped ion exchange membrane electrolyzer according to the present invention has a configuration in which the ion exchange membrane and cathode chamber inner space including the gas diffusion electrode are separated by the liquid retaining member. This prevents the anolyte that has been transferred through the ion exchange membrane according to the concentration gradient to the cathode chamber from corroding the components in the cathode chamber even during the stop time of the electrolyzer, allowing performance of the electrolyzer to be maintained for a long period of time.

EXPLANATION OF SYMBOLS

1: Gas diffusion electrode equipped ion exchange membrane electrolyzer

10: Ion exchange membrane
20: Anode chamber
30: Cathode chamber
211: Anode
213: Anolyte
215: Anolyte inlet
217: Anolyte and gas outlet
219: Anode chamber frame
221: Anode chamber side gasket
301: Cathode chamber inner space
311: Liquid retaining member
311*a*: Outer peripheral surface contacting gasket
311*b*: Outer peripheral end face
312: Sealing portion
313: Gas diffusion electrode
315: Elastic member
317: Cathode gas chamber
319: Oxygen inlet
321: Cathode gas chamber outlet
323: Cathode chamber frame
323*a*: Void
325: Cathode chamber side gasket
325*a*: Void
325*c*: Gasket extension portion
325*d*: Joining portion
326: Cathode chamber frame side gasket
326*a*: Void
327: Back plate

The invention claimed is:

1. A gas diffusion electrode equipped ion exchange membrane electrolyzer comprising:

an anode in an anode chamber wherein the anode chamber comprises an anolyte;

a cathode chamber having an inner space defined by a cathode chamber wall;

a gas diffusion electrode disposed at least in part in the cathode chamber;

an ion exchange membrane disposed at least in part between the anode chamber and the cathode chamber;

a liquid retaining member separating the ion exchange membrane from the inner space of the cathode chamber wherein the liquid retaining member fluidically separates the anolyte from the inner space of the cathode chamber;

a gasket disposed adjacent the cathode chamber wall and at least a portion of the liquid retaining member.

2. The gas diffusion electrode equipped ion exchange membrane electrolyzer according to claim 1, wherein the liquid retaining member is a hydrophilic member that retains a liquid within the inner space thereof.

3. The gas diffusion electrode equipped ion exchange membrane electrolyzer according to claim 2 wherein the hydrophilic member is a carbon fiber fabric or a carbon fiber nonwoven fabric.

4. A manufacturing method of an alkali metal hydroxide aqueous solution comprising:

providing the gas diffusion electrode equipped ion exchange membrane electrolyzer as claimed in any of claims 1 to 3;

supplying alkali metal chloride solution to the electrolyzer; and generating alkali metal hydroxide aqueous solution.

5. A manufacturing method of chlorine comprising:

providing the gas diffusion electrode equipped ion exchange membrane electrolyzer as claimed in any of claims 1 to 3;

supplying alkali metal chloride solution to the electrolyzer; and generating chlorine.

* * * * *